US006494598B2

(12) United States Patent
Yeh

(10) Patent No.: US 6,494,598 B2
(45) Date of Patent: Dec. 17, 2002

(54) RELEASABLE STRUCTURE FOR LUMINAIRE

(76) Inventor: Chao-Kun Yeh, No. 2-3, Alley 16, Lane 337, Sec. 1, Datung Rd., Shijr City, Taipei Hsien (TW)

( * ) Notice: Subject to any disclaimer, the term of this patent is extended or adjusted under 35 U.S.C. 154(b) by 0 days.

(21) Appl. No.: 09/842,728

(22) Filed: Apr. 27, 2001

(65) Prior Publication Data

US 2002/0159263 A1 Oct. 31, 2002

(51) Int. Cl.[7] ..... F21V 1/00
(52) U.S. Cl. ..... 362/356; 362/351
(58) Field of Search ..... 362/351, 352, 362/355, 356, 357, 358

(56) References Cited

U.S. PATENT DOCUMENTS 4,539,631 A * 9/1985 Lieberman ..... 362/351
4,745,532 A * 5/1988 Mo ..... 362/352
5,051,879 A * 9/1991 Bunger ..... 362/351
5,571,280 A * 11/1996 Lehrer ..... 362/351
5,662,412 A * 9/1997 Glendmyer ..... 362/352

* cited by examiner

*Primary Examiner*—Laura K. Tso
(74) *Attorney, Agent, or Firm*—Rosenberg, Klein & Lee

(57) ABSTRACT

Releasable structure for luminaire is composed of a fixture frame having a conjoining collar at its top portion; and a foldable and releasable shade covering over the fixture frame and fixing its one end on the conjoining collar thereby forming a luminaire contour. The upper part of the shade above the foldable crease is formed into a supporting slant side surface of frustum of a cone, this slant surface can be flexed downward along the foldable crease so as to form the shade into an opened conical contour.

2 Claims, 4 Drawing Sheets

RELEASABLE STRUCTURE FOR LUMINAIRE

BACKGROUND OF THE INVENTION

1. Field of the Invention

The present invention relates to releasable structure for luminaire, in particular, to a luminaire which can be rapidly assembled, or folded and released so as to be conveniently transported or stored.

2. Description of the Prior Art

FIG. 1 is a three dimensional view of a conventional luminaire. It is constructed by a conical shade 1 with an open top and bottom hard structure supported with a fixture frame 2 to form a luminair contour. A light source, for example, a bulb is installed on a socket mounted at the base of the fixture frame 2 thus completing a lighting luminaire.

However, the conventional luminaire constructed as such has several disadvantages, in particular:

1. In case the shade 1 and fixture frame 2 are made integrally unreleasable, it causes inconveniency in storage and transportation owing to its bulky size.
2. In case the shade 1 and fixture frame 2 are bound together with a binder or other means after separately formed, it is apt to collapsed by inadvertent impact or tampering during transportation, or installation. Particularly, it may cause harzardous leakage of electricity, fire or even casualities if the luminaire collapses and falls down from its installed position.
3. The conventional luminaire formed as such is frangible at the joint portion of the shade 1 and fixture frame 2 because the shade 1 is hard to flex resulting in affecting luminaire durability.
4. It is uneconomical that in case either one of shade 1 or fixture frame 2 is destructed, the whole luminaire shall be thrown away.

In order to palliates these disadvantages, the present invention is to propose a newly developed releasable structure for luminaire.

SUMMARY OF THE INVENTION

It is an object of the present invention to provide a releasable structure for luminaire which can be rapidly assembled, or folded and released so as to be conveniently transported or stored.

It is another object of the present invention that the luminaire can have an appealing contour with an exquisite, diverse and lustrous figure painted thereon.

It is a further object of the present invention that the luminaire is resistive to external destructive force, and a damaged component is individually replaceable so that the luminaire's lifetime can be economically prolonged thereby saving the usher's money.

To achieve aforesaid objects; the releasable structure for the luminaire of the present invention is composed of a fixture frame having a conjoining collar at its top portion; and a foldable and releasable shade covering over the fixture frame and fixing one end on the conjoining collar thereby forming a luminaire contour with the open shade. The luminaire structure is characterized in that the shade has a foldable crease having a width enough to encircle around the conjoining collar. The upper part of the shade above the foldable crease is formed into a supporting slant side surface of a frustum of a cone, the supporting slant side surface can be flexed downward along the foldable crease so as to form the shade into an opended conical contour. At this time a circular groove is formed around a gap between the crease and the opended shade, this circular groove is used to support the shade on the fixture frame by inlaying into the conjoining rim thereby completing a firm structure of the luminaire.

BRIEF DESCRIPTION OF THE DRAWINGS

The drawings disclose illustrative embodiments of the present invention which serves to exemplify the various advantages and objects hereof, and are as follows.

DETAILED DESCRIPTION OF THE PREFERRED

EMBODIMENT

Figure 1:
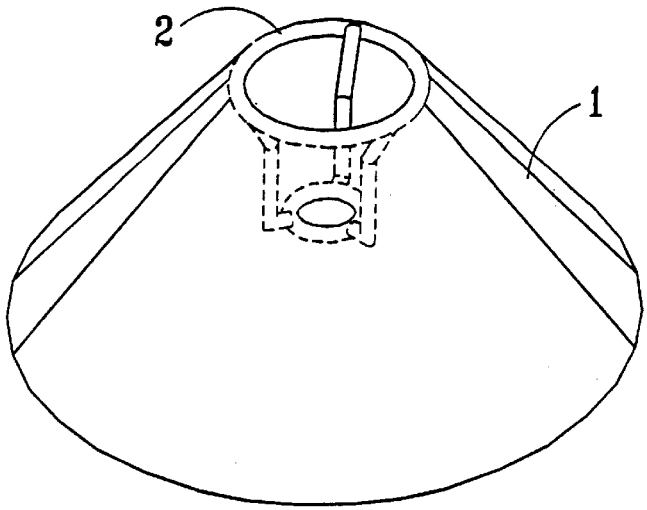
FIG. 1 PRIOR ART
FIG. 1 is a three dimensional view of a structure for a conventional luminaire.
Figure 2:
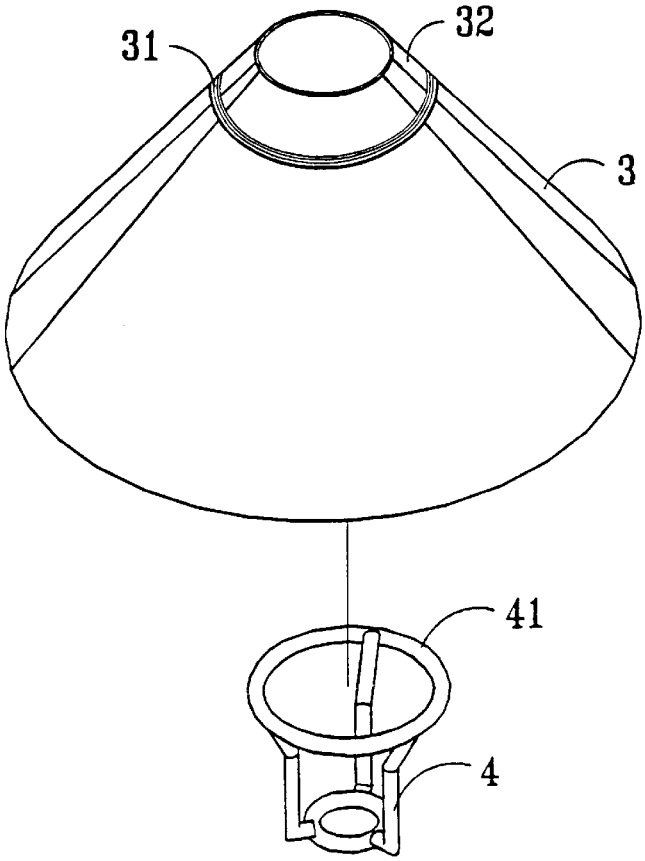
FIG. 2 is a three dimensional exploded view of releasable structure for luminaire of the present invention.
Figure 3:
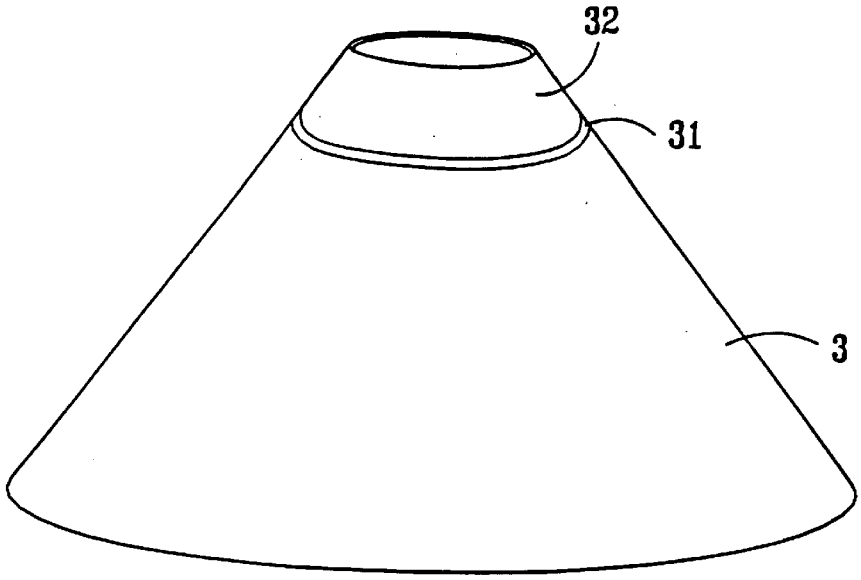
FIG. 3 through FIG. 5 are views showing the component parts of the luminaire of the present invention and their assembly procedure.
Figure 4:
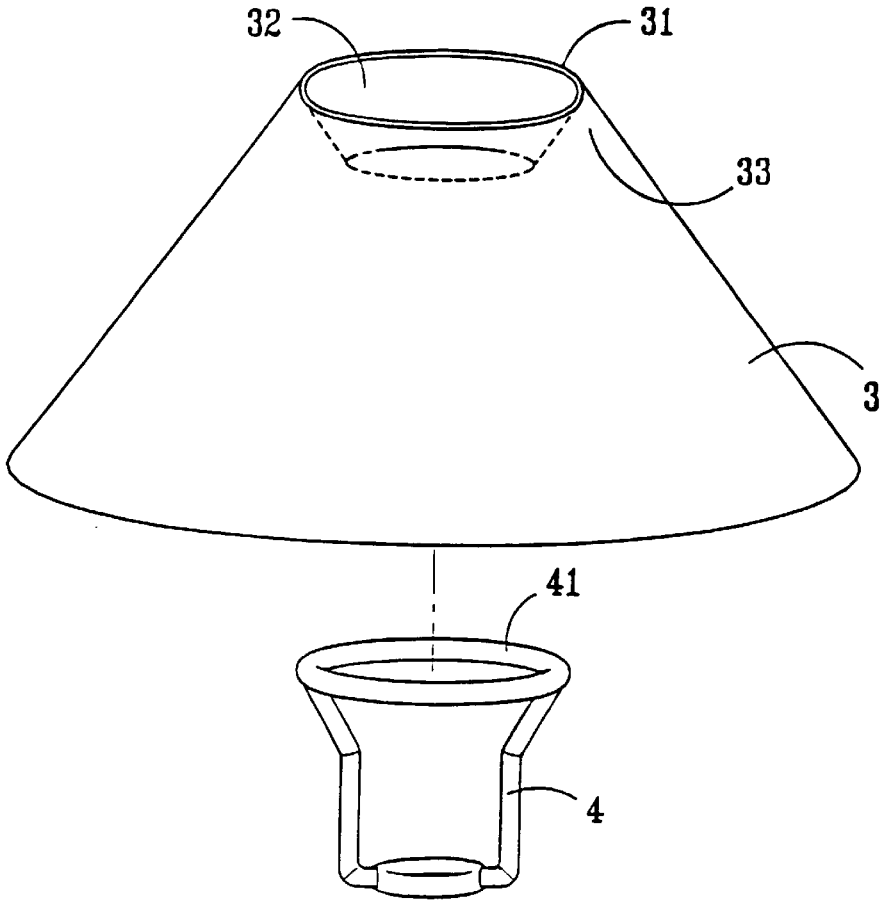
Figure 5:
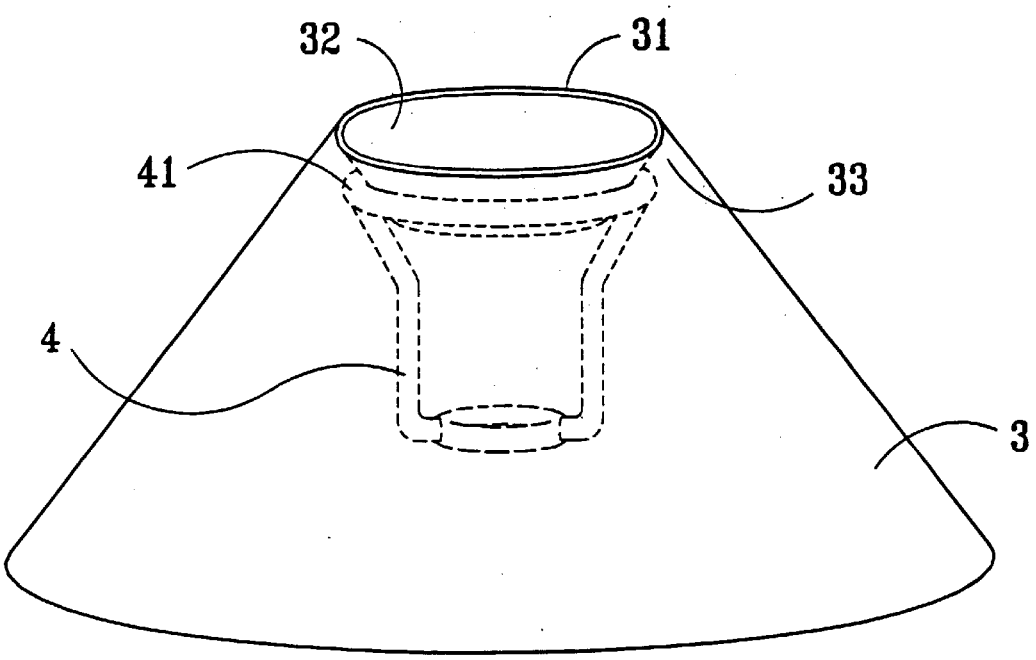
Figure 6:
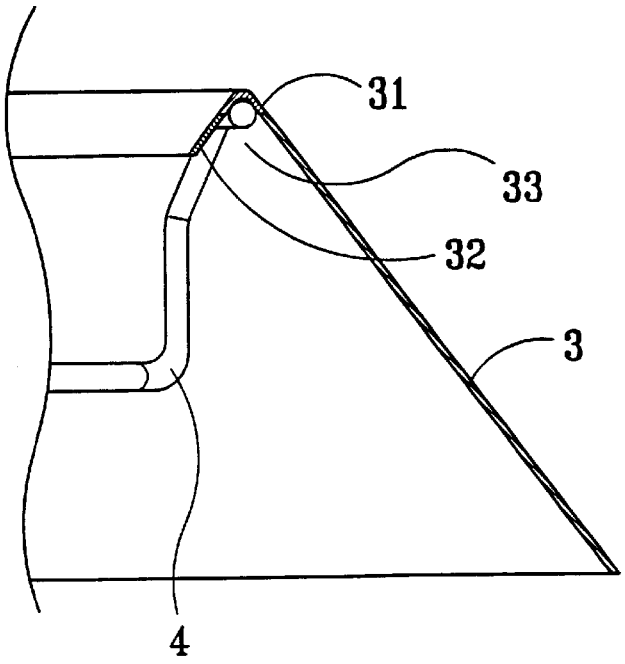
FIG. 6 is a fragmentary cross sectional view of the supporting slant surface of the shade according to present invention.

For understanding the innovative structure of the present invention, reference should be made to FIG. 2 in which the releasable luminaire of the present invention is composed of fixture frame 4 having a conjoining collar 41 at its top portion; and a foldable and releasable shade 3 covering over the fixture frame 4 and fixing its one end on the conjoining collar 41 thereby forming a luminaire contour with the open shade 3. Before being assembled into a luminaire, the shade 3 is folded to minimize its size so as to be conveniently transported and stored. The shade 3 is further provided with a foldable crease 31 having a width enough to encircle around the conjoining collar 41. The upper part of the shade 3 above the crease 31 is formed into a supporting slant side surface 32 in a shape of frustum of a cone, this supporting slant side surface 32 can be flexed downward along the crease 31 so as to form the shade 3 into a conical contour.

Referring successively form FIG. 3 to FIG. 7 wherein the supporting slant side surface 32 of the frustum of a cone is flexed downward along the foldable crease 31 so as to form the shade 3 into an opened conical contour. At this time a circular groove 33 is formed around a gap between the crease 31 and the opened shade 3, this circular groove 33 functions to support the shade 3 on the fixture frame 4 by inlaying the conjoining rim 41 thereinto thereby completing a firm structure of the luminaire. For further enhancing an attaching force between the shade 3 and the fixture frame 4, a binder or the like can be applied therebetween. An exquisite, diverse and lustrous figure may be painted on the shade 3 to make the luminaire more appealing.

Figure 7:
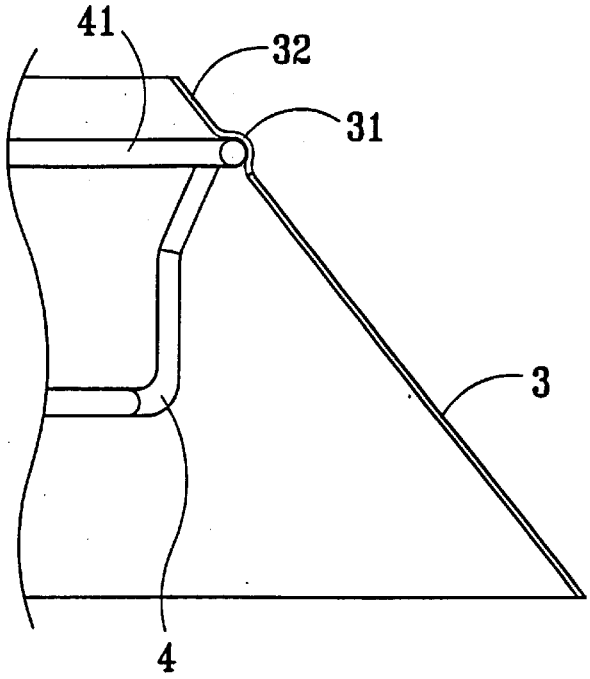
FIG. 7 is a fragmentary schematic view of the luminaire in another embodiment of the present invention.
Figure 8:
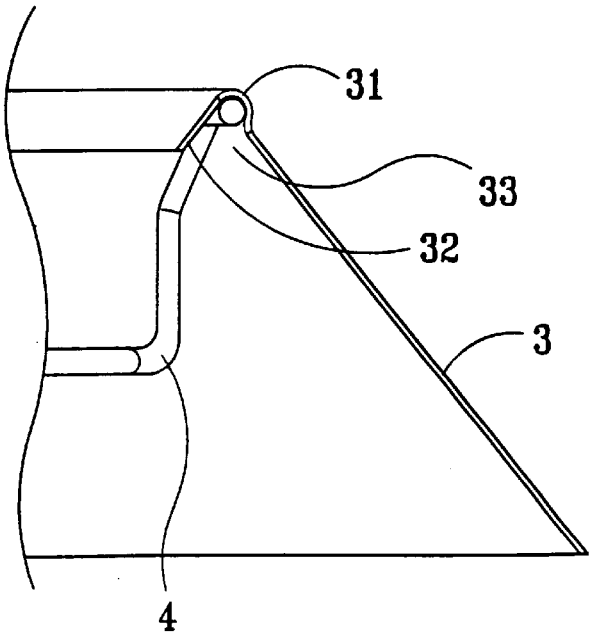
FIG. 8 is a fragmentary illustrative view showing the component parts in the assembled luminaire in the embodiment of FIG. 7.

For understanding another embodiment of the present invention, reference should be made to FIGS. 7 and 8, wherein the foldable crease 31 is pushed outward by the conjoining rim 41 to form a flange, when the slant side surface 32 of the shade 3 is flexed downward, the conjoining rim 41 is just squeezed into the flange such that the shade 3 and the fixture frame 4 are more tightly conjoined.

It emerges from the above description that the invention has several noteworthy advantages, in particular:

1. The luminaire of the present invention can be rapidly assembled, or released so as to be conveniently transported or stored.
2. The luminaire of the present invention can have an appealing contour with an exquisite, diverse, and lustrous figure painted thereon.
3. The luminaire of the present invention is resistive to external destructive force, and a damaged component is individually replaceable so that the luminaire's lifetime can be economically prolonged thereby saving the user's money.

Those who are skilled in the art will reality perceive how to modify the invention. Therefore, the appended claimed are to cover all equivalent structures which fall within the true scope and spirit of the invention.

What is claimed is:

1. Releasable structure for luminaire comprising:

a fixture frame having a conjoining collar at its top portion; and a foldable and releasable shade covering over said fixture frame and fixing its one end on said conjoining collar thereby forming a luminaire contour with said open shade;

said luminaire structure is characterized in that said shade has a foldable crease with a width enough to encircle around said conjoining collar, the upper part of said shade above said foldable crease is formed into supporting slant side surface in a shape of frustum of a cone, said supporting slant side surface is flexed downward along said foldable crease so as to form said shade into an opened conical contour, at this time a circular groove is formed around a gap between said foldable crease and said opened shade, this circular groove is used to support said shade on said fixture frame by inlaying said conjoining rim thereinto thereby completing a firm structure of the luminaire.

2. The releasable structure for luminaire of claim 1, wherein said foldable crease is pushed outward by said conjoining rim to form a circular flange to further enhance conjoining effect between said shade and said fixture frame.

* * * * *